US005146680A

United States Patent [19]

Bakhos

[11] Patent Number: 5,146,680

[45] Date of Patent: Sep. 15, 1992

[54] SHAVING APPARATUS AND METHOD

[76] Inventor: Youssef G. Bakhos, 9171 Aubrey Cir., Villa Park, Calif. 92667

[21] Appl. No.: 561,231

[22] Filed: Jul. 25, 1990

Related U.S. Application Data

[63] Continuation-in-part of Ser. No. 07/236,375, Mar. 21, 1989, abandoned.

[51] Int. Cl.[5] ..... B26B 21/40

[52] U.S. Cl. ..... 30/90; 30/34.2

[58] Field of Search ..... 30/34.2, 90, 34, 32, 30/84, 85, 340

[56] References Cited

U.S. PATENT DOCUMENTS 2,275,810 3/1942 Weiland ..... 30/34.2

3,895,437 7/1975 Buono ..... 30/90

*Primary Examiner*—Timothy V. Eley

*Assistant Examiner*—Willmon Fridie, Jr.

[57] ABSTRACT

Disclosed is a conventional safety razor having a sounding board disposed immediately behind and approximately coextensive and even with the razor head, the sounding board being in the form of a thin plastic plate extending upwardly from the razor handle, with the plate serving as both a means for scraping hair stubble on human skin, as well as a means for audibly amplifying vibrations induced thereby. This alerts the user to the continued presence of objectionable hair stubble so that the shaving process is repeated with or without a change of safety razors or razor blades as required. Alternatively, a miniature solid-state microphone may be mounted on the safety razor for sensing the vibrations and driving an audio speaker through an amplifier/filter network.

8 Claims, 2 Drawing Sheets

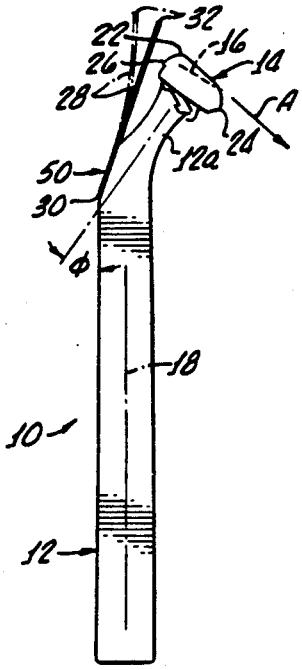
FIG. 1.
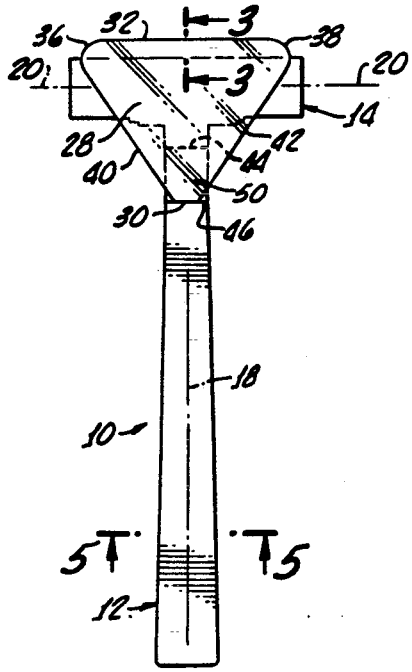
FIG. 2.
FIG. 3.
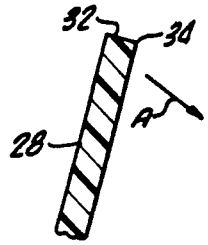
FIG. 5.
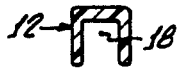
FIG. 4.
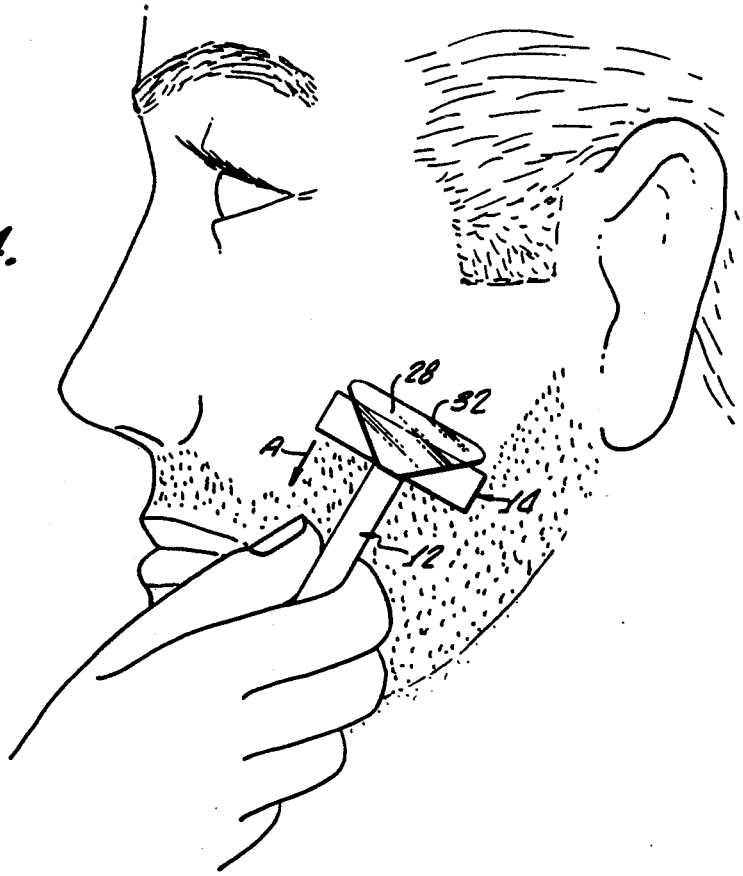

SHAVING APPARATUS AND METHOD

This is a continuation-in-part of Applicant's prior application, Ser. No. 07/326,375 filed Mar. 21, 1989 of the same title, now abandoned.

BACKGROUND OF THE INVENTION

This invention relates to shaving apparatus and methods, and has more particular reference to audible sonic amplification features for a safety razor, and a user cognizant method for taking advantage of such sonic amplification to facilitate personal shaving.

Both men and women have for years utilized safety razors for shaving. In the case of men, typically it is for facial hair (beard) and stubble. Whereas, for women, typically, it is shaving hair and stubble from the legs and/or under-arms.

Both men and women, from time to time, inadvertently fail to adequately shave such body features as desired, and there can remain a hair stubble which can be felt, and sometimes is even visably noticeable to others. Generally this is undesirable, and can result from many causes; for example, the inattention of the person shaving, or perhaps any one of many physical handicaps of such person including eyesight, touch and feel, or perhaps even hearing. Such handicaps are of varying degree and can result from many different causes, including accidents, birth defects, aging, strokes and numberless other causes. A numbness of the sense of touch is not uncommon.

It is therefor desirable to provide an enhanced sensory feedback to the human user of a safety razor in order to alert such user to this problem, so that if more shaving in the same area is needed it will be done; or, if the blade of the safety razor has become dull, it will be changed, of if the safety razor is of the disposable variety, a new disposable safety razor with sharp blades will be substituted, thus in net effect causing a change of razor blades.

So far as I am aware at this time, there has been no apparatus or method involving safety razors and their personal use by the shaver, which significantly addresses these problems.

Most everyone is familiar with the modern safety razor. However, for specific reference, attention is directed to U.S. Pat. No. 3,374,540 to Longuyon and U.S. Pat. No. 2,771,673 to Nash, both of which show injector safety razors having razor heads in which the razor blades are changeable. Of course, the cheaper disposable safety razors have one or a pair of razor blades permanently mounted in the razor head, it being contemplated that the entire safety razor will be disposed of rather than by changing a blade carrier or blades. There are, of course, many different forms of safety razors, in which razor blades either separately or pre-mounted in disposable blade carriers may be changed as required for sharpness.

The safety razors cited in the above patent references exemplify a conventional form, and have structural frames including a razor head and an elongated hollow handle extending therefrom. The razor head is mounted at the far end of a neck which extends at a forward angle from the upper or distal end of the elongate handle, with the elongate transverse width or shaving line of the razor head and blades carried thereby extending transversely to the handle and neck.

SUMMARY OF THE INVENTION

In accordance with my invention, shaving apparatus for shaving hair from human skin and for alerting the user to the continued presence of significant hair stubble on the skin, comprises a safety razor having a structural frame including a razor head and an elongate handle extending therefrom, combined with a scraping means and a cooperative amplifying means, both mounted on the structural frame of the razor. The scraping means is any means for scraping hair stubble on human skin and receiving induced vibrations therefrom as the razor head is passed along the skin. The amplifying means is responsive to said induced vibrations in the scraping means for audibly amplifying said vibrations to alert the user to the continued presence of hair stubble.

This may be accomplished through the use of a sounding board (sound board) having a proximal end and a free distal end; and, means mounting the proximal end of the sounding board to the handle so that the free distal end of the board resides in proximate parallel alignment with and spaced rearwardly from the razor head.

The free distal end of the sounding board is substantially straight and resides about even with or protrudes slightly beyond the razor head. This free distal end serves as the scraping means and has a sharply defined forward edge for scraping hair stubble on the skin and transmitting vibrations induced thereby to the sounding board which acts as the means for audible amplification of such vibrations for cognizance by the user.

The sounding board may be in the form of a thin plastic plate having a straight and free distal end and having a proximal end secured to the razor handle, the plate being sufficiently thin and stiff and having a sufficient unsupported area to operate effectively as a sounding board, with the extent of the plate between its distal and proximal ends being sufficient to permit the plate to flex with the application of normal shaving force applied to the safety razor by the user so that the plate does not interfere with the shaving process. Because of the positioning of the plastic plate, it may be used to scrape stubble and audibly amplify resulting vibrations without directly engaging the razor head with the skin.

Preferably, the thin plastic plate is transparent and has an outline approximately in the form of an equilateral triangle, with one side of the triangle forming said free distal end and being rounded at the respective corners where it joins the two adjacent sides of the triangular outline.

Whether the scraping means be the distal end of a sound board or one or more razor blades mounted on the razor head, the vibrations induced therein by the scraping of beard stubble will be transmitted to the structural frame of the safety razor, and if desired a more elaborate electrical implementation of the audio amplification of such vibrations may be achieved in accordance with the invention by mounting a miniature solid-state microphone on the structural frame for sensing the vibrations and producing corresponding electrical signals, the microphone being coupled to an audio speaker by electrical filtering and amplification means for selectively amplifying such electrical signals for driving the audio speaker.

Of course, other vibration sensitive and audio amplifying means could be employed, it being the method of my invention to sense and audibly amplify vibrations from the scraping of stubble with the safety razor for cognizance by the human user so as to alert the user to the need for continued shaving of the same area until the audible level is satisfactorily reduced, or alternatively to use the step of changing the blades or safety razor responsive to a continuation of such cognizance in order to reduce such audible level with sharper blades, thereby assuring a proper shaving of the skin area involved.

The foregoing and other important features of my invention will be more clearly understood by reference to the description of a preferred embodiment thereof made in conjunction with the accompanying drawings.

BRIEF DESCRIPTION OF THE DRAWINGS

In the drawings:

FIG. 1 is a side elevation of the preferred embodiment of the apparatus of my invention;

FIG. 2 is a rear elevation of the apparatus of FIG. 1;

FIG. 3 is a fragmentary side sectional view of the distal end portion of the sounding plate of FIGS. 1 and 2, taken along line 3—3 of FIG. 2;

FIG. 4 is a schematic perspective view of a male user employing the apparatus of FIGS. 1 thru 3 for shaving a facial beard; and, FIG. 5 is a cross-section of the safety razor handle taken along line 5—5 of FIG. 2.

DETAILED DESCRIPTION OF THE DRAWINGS

Figure 6:
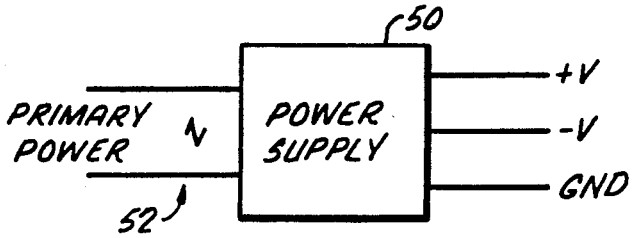
FIGS. 6 and 7 are schematic electrical diagrams illustrating the sensing and audio amplification of induced vibrations from the scraping of beard stubble by a microphone/electrically driven audio speaker system, with the power supply therefor being illustrated in FIG. 6.

Referring now to the drawings, shown is a conventional disposable safety razor having a structural frame 10. The structural frame includes a substantially hollow elongate handle 12 and a razor head 14 supported at the top or distal end of the handle 12. The razor head has permanently mounted therein one or more razor blades generally indicated by the dotted line 16. These blades face in the forward shaving direction, generally indicated by the Arrow A.

The handle 12 is connected to the razor head 14 through an integral plastic neck 12(*a*) which serves as an aligned angularly upward extension of the handle, and which conventionally extends therefrom at a forward angle $\phi$ of about 40° to 45°.

The handle 12 is centrally disposed and has a general longitudinal axis 18. The razor head 14 is elongate along a general axis 20 which extends transverse to the handle 12 and its axis 18.

The razor head 14 has an upper surface 22, a forward facing portion 24 and a rearward facing portion 26.

The foregoing is conventional structure for a disposable safety razor. For conventional safety razors which are not disposable, as is well known, the razor head 14 would be adpated to receive the injection of razor blades in order to change blades when they become dull, or alternatively to releasably mount a plastic razor blade carrier which itself incorporates such blades and is disposable. Such constructions are conventional, well known, and commonly available.

A sounding board 28 having a proximal end 30 and a free distal end 32 is mounted to the handle so that the free distal end 32 resides in proximate parallel alignment with, and spaced slightly rearwardly from, the razor head 14.

The free distal end 32 of the sounding board 28 is substantially straight and resides about even with, or preferably protrudes slightly beyond the top surface 22 of the razor head 14, and is about of equal elongate extent as the razor head. This free distal end 32 serves as a scraping means and has a sharply defined forward edge 34 for scraping hair stubble on the skin and transmitting vibrations induced thereby to the sounding board 28, which acts as a means for audible amplification of such vibrations for cognizance by the user.

The sounding board 28 is in the form of a thin, transparent plastic plate having an outline approximately in the form of an equilateral triangle, with one side of the triangle forming said free distal end 32 and being rounded at the respectove corners 36, 38 where it joins the two adjacent sides 40, 42 of the triangular outline.

A flat area is machined at the juncture of the handle 12 and its neck extension 12(*a*) on the backside thereof, the upper extremity of the flat area being shown as the dotted line 44 (FIG. 2) and the lower extremity of the flat area being indicated at 46 and being approximate coincident with the proximal end extremity 30 of the thin plastic plate. The general proximal end area of the plastic plate is secured by permanent adhesive (e.g., epoxy cement) or otherwise bonded to said flat area, as generally indicated at 50.

As with the neck extension 12(*a*), said flat area is also inclined at a forward angle to the handle, so that the attached sounding board or plastic plate 28 extends at a forward angle of about $\frac{1}{2}\phi$ in its normal unflexed position (shown in solid line in FIG. 1), to better address the skin as a scraping means.

For various reasons, including being unobtrusive and facilitating its function as a sounding board and its mounting on the razor handle, the plastic plate or sounding board 28 tapers from the distal end 32 to become relatively narrow at its proximal end 30. The thin plate 28 can be constructed of any suitable plastic and may for example have a thickness of about 1.0 millimeter, the principal critiera being only that the plate be sufficiently thin and stiff and have a sufficiently unsupported area to operate effectively as a combined scraping means and sounding board to audibly amplify the vibrations.

The extent and shape of the plate or sounding board 28 between its distal and proximal ends 32, 30, respectively, is chosen also to permit the plate to flex (as indicated by the dotted line position in FIG. 1 for the plate 28) this distance being typically about one inch, or slightly more. This flexing of the plate, especially if the plate extends beyond the razor head 14, is occasioned by the application of normal shaving force applied to the safety razor by the human user so that the plate does not interfere with the normal shaving process.

The use of apparatus is illustrated in FIG. 4 where the user is depicted as a human male shaving his facial beard in the downward direction, along the general direction of beard growth. Because of the positioning of the plate or sounding board 28 relative to the razor head, the user can engage the skin with or without also engaging the razor head itself, and the user can scrape stubble with the sounding board or plate 28 to ascertain the continued presence of stubble by moving the plate over the skin in any direction including the opposite direction, or against the grain or stubble of the beard for better scraping and sound amplification. If the razor blades are dull, then they can be changed or the apparatus can be discarded and a new replacement disposable safety razor utilized to properly shave the area.

The transparency of the sounding board or plate 28 is preferred because it is user friendly (razors are highly personal), and this readily reveals contamination with shaving cream and beard stubble and the need for cleaning the same to enhance its continued effectiveness as a scraper and sounding board.

Figure 7:
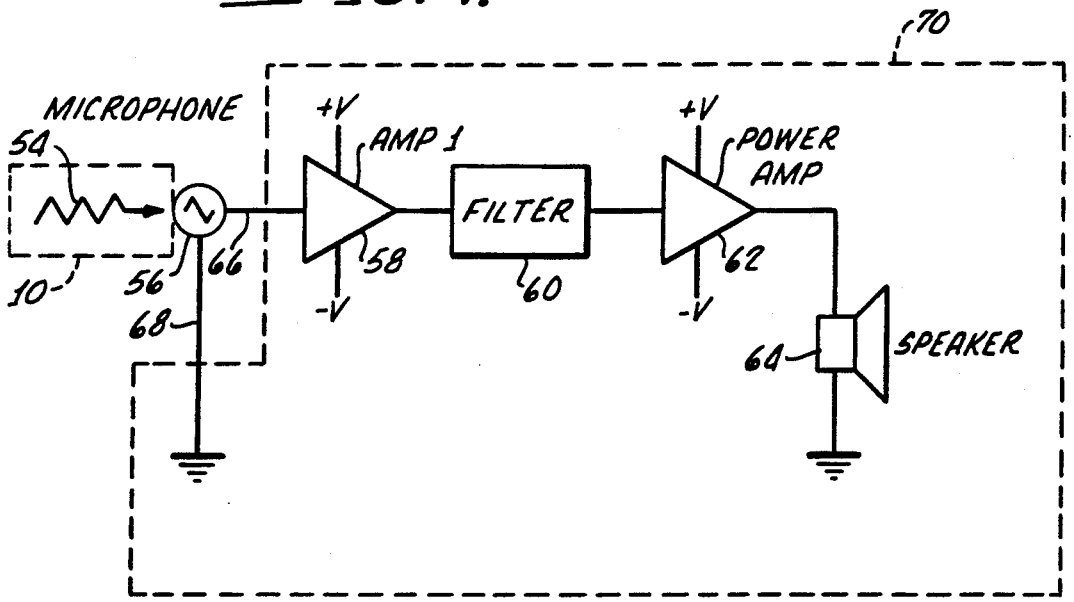

Referring now to FIGS. 6 and 7, an electrical system is illustrated for sensing vibrations in the structural frame of the safety razor induced by the scraping of beard stubble and audibly amplifying such vibration.

FIG. 6 illustrates a conventional power supply 50 to be plugged into a conventional AC current outlet from which it receives primary power at its input 52, so as to provide positive and negative output voltages designated respectively as "+V" and "−V", all as reference to ground designated "GND".

In FIG. 7, the vibrations designated by the arrow 54 in the structural frame 10 are picked up by a miniature solid-state microphone 36, which produces corresponding electrical signals which are fed to a pre-amplifier 58 designated "AMP 1" and through a conventional narrow band-pass filter 60 to a power amplifier 62 which, in turn, drives an audio speaker 64.

Miniature microphones are commercially available and can be very small insulated chips or crystals which exhibit piezoelectric properties. Since the microphone is acting as a vibration transducer, it is firmly mounted at a convenient location on the structural frame 10 of the safety razor by conventional means, such as a clamp, clip or, if desired, permanently mounted with epoxy cement, this being a matter of choice.

A pair of insulated lead wires 66, 68 extend from the microphone which couple it to the balance of the electrical system. The remainder of the electrical system, including speaker 64, would not have to be mounted on the safety razor itself but could be otherwise mounted in a separate console as illustrated by the dotted line enclosure 70 in FIG. 7 which also would receive the output from the power supply 50.

The function of the band pass filter 60 is to selectively pass frequencies in the general range of those resulting from vibrations induced by the scraping of hair stubble while, relatively, repressing extraneous noise signals, if any, outside that band in order to give preferential ultimate audio amplification to those signals resulting from the scraping of hair stubble, this being a conventional provision once the objective is known.

If desired, all of the components of the electrical system could be miniaturized including the speaker and mounted in or adjacent the hollow handle of the razor together with miniature batteries as a power supply.

Having now described and illustrated two specific alternate embodiments of my invention, it is to be understood that my invention is not limited in its scope by the details illustrated, but only by the scope of the claims appended hereto. As used herein, the expression "sounding board" is intended to be synonymous with "sound board".

I claim:

1. Shaving apparatus for shaving hair from human skin and for alerting the user to the continued presence of significant hair stubble on the skin comprising, in combination:

(a) a safety razor having a structural frame including a razor head and an elongate handle extending therefrom;

(b) means mounted on said structural frame for scraping hair stubble on human skin and receiving induced vibrations therefrom as the razor head is passed along the skin; and, (c) means responsive to said induced vibrations in the scraping means, for audibly amplifying said vibrations to alert the user to the continued presence of hair stubble.

2. The apparatus of claim 1, wherein:

(a) the razor head has an upper surface, a forward facing portion, one or more razor blades exposed in said forward facing portion, and a rearward facing portion, said razor head being elongate transversely to the elongate handle;

(b) a plastic plate is secured to the structural frame, said plastic plate having a proximal end secured to the structural frame, and having a straight and free distal end disposed parallel to and displaced rearwardly from the razor head, said straight distal end of the plate being approximately even with or protruding slightly above the said upper surface of the razor head, and being approximately of equal elongate extent therewith;

(c) said straight distal end of the plate acting as the scraping means; and, (d) said plate being sufficiently thin and stiff and having a sufficient unsupported area to operate as a sounding board to audibly amplify said vibrations induced in the scraping means.

3. The apparatus of claim 2, wherein the straight distal end of the plate has a sharply defined forward edge to enhance its function as the scraping means.

4. The apparatus of claim 2, wherein:

(a) the plate has an outline which tapers from the straight distal end to become relatively narrow at the proximal end;

(b) the relatively narrow proximal end of the plate is secured to the handle; and, (c) the extent of the plate between said distal and proximal ends is sufficient to permit the plate to flex with the application of normal shaving force applied to the safety razor by the human user.

5. The apparatus of claim 4, wherein the plate has an outline approximately in the form of an equilateral triangle, with one side of the triangle forming said free distal end of the plate nad being rounded at respective corners where it joins the two adjacent sides of the triangular outline.

6. In combination with a safety razor having a razor head mounting one or more razor blades in a forward direction for shaving human hair stubble from the skin of the user and an elongate handle attached to said razor head and extending transverse thereto, the improvement which comprises:

(a) a sounding board formed as a thin plastic plate having a proximal end and a free distal end; and, (b) means mounting the proximal end of the sounding board to the handle so that the distal end of the board resides proximate to and spaced rearwardly from the razor head;

(c) said free distal end of the sounding board being straight and parallel to the razor head and having a sharply defined forward edge for scraping hair stubble on the skin and transmitting vibrations induced thereby to the sounding board for audible amplification and cognizance by the user.

7. The apparatus of claim 1 wherein the means responsive to the said induced vibrations in the scraping means for audibly amplifying said vibrations to alert the user, comprises:

(a) a miniature solid-state microphone mounted on said structural frame for sensing said vibrations induced in the scraping means and producing corresponding electrical signals;

(b) an electrically driven audio speaker; and, (c) electrical filtering and amplification means coupling the microphone to the speaker for selectively amplifying electrical signals corresponding to vibrations induced in the scraping means by the scraping of hair stubble and driving the audio speaker therewith.

8. The apparatus of claim 7, wherein the scraping means comprises one or more razor blades mounted on the razor head of the structural frame of the safety razor.

* * * * *